US006557542B1

(12) United States Patent
Orr

(10) Patent No.: US 6,557,542 B1
(45) Date of Patent: May 6, 2003

(54) ACCUMULATOR CHAMBER FOR GUN

(76) Inventor: Robert G. Orr, 13517 ½ Alondra Blvd., Santa Fe Springs, CA (US) 90670

( * ) Notice: Subject to any disclaimer, the term of this patent is extended or adjusted under 35 U.S.C. 154(b) by 105 days.

(21) Appl. No.: 09/706,419

(22) Filed: Nov. 3, 2000

Related U.S. Application Data

(60) Provisional application No. 60/163,670, filed on Nov. 5, 1999.

(51) Int. Cl.[7] ..... F41B 11/12; F41B 11/16; F41B 11/32

(52) U.S. Cl. ..... 124/70; 124/67; 124/68; 124/56

(58) Field of Search ..... 124/70, 63, 64, 124/65, 66, 67, 68, 76

(56) References Cited

U.S. PATENT DOCUMENTS 3,951,038 A * 4/1976 Van Langenhoven ..... 102/702
3,951,126 A * 4/1976 Rau ..... 124/67
3,964,365 A * 6/1976 Zielinski ..... 124/68

FOREIGN PATENT DOCUMENTS

DE 3812219 A1 * 10/1989

* cited by examiner

*Primary Examiner*—Charles T. Jordan
*Assistant Examiner*—Floris Copier
(74) *Attorney, Agent, or Firm*—Colin P. Abrahams

(57) ABSTRACT

A gas accumulator is provided for attachment to a gun having a gun body, a compressed gas chamber in the gun body, and a compressed gas power source. The accumulator comprises a body portion defining a gas accumulator chamber and connector means for connecting the accumulator releasably to the gun body so that the gas chamber in the gun body is in communication with the accumulator chamber. Compression means are provided in the accumulator chamber which is compressed when the accumulator chamber receives gas under pressure, the compression means forcing gas from the accumulator chamber into the gas chamber when the gun is fired.

9 Claims, 6 Drawing Sheets

FIG. 7
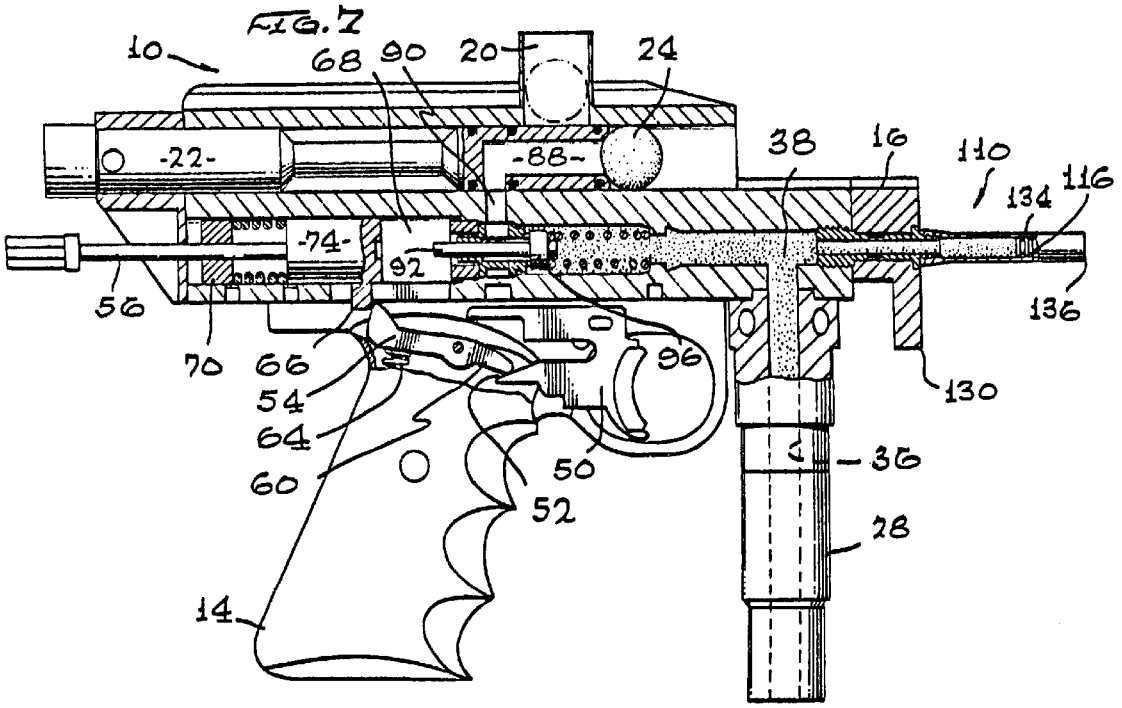
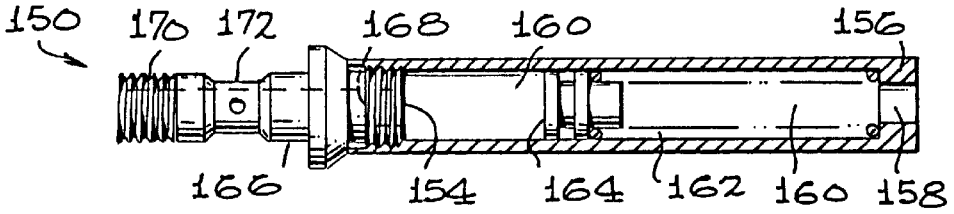
FIG. 8
FIG. 9
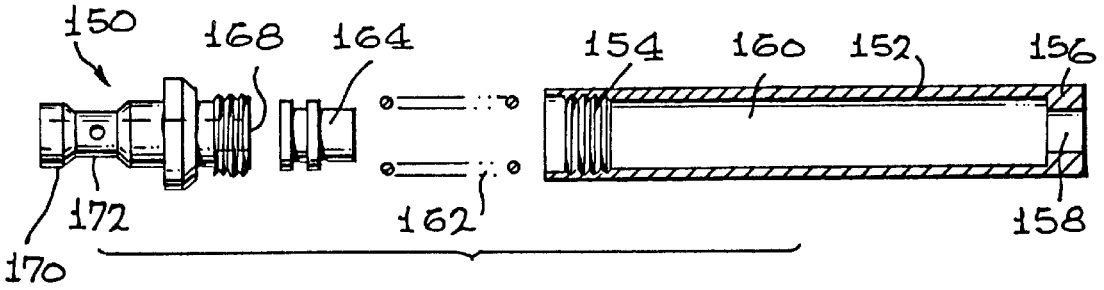

ACCUMULATOR CHAMBER FOR GUN

CROSS REFERENCE TO RELATED APPLICATIONS

This application claims the benefit of U.S. Provisional application No. 60/163,670 filed Nov. 5, 1999.

FIELD AND BACKGROUND OF THE INVENTION

This invention relates to air guns, and more particularly to such guns which fire paintball tags. These are referred to in the specification as "paintball guns". Particularly, the invention is for an accumulator chamber which forms part of, or is attached to, the front block of a gun, in order to provide additional air pressure and force for firing a paintball tag.

The paintball gun of the invention relies on a source of power which can be releasably attached to and detached from the paintball gun in order to provide the necessary force and thrust to fire the paintball tag through the barrel of the gun. This power source may typically be one which provides carbon dioxide ($CO_2$), nitrogen, compressed air, or some other appropriate gas, which is maintained under pressure and released by the user of the paintball gun when the paintball tag is to be fired.

As mentioned, most paintball guns presently available run off $CO_2$, nitrogen, compressed air or some other gas as a power source. In order to fire and project a paintball tag at the correct velocity, and to an acceptable distance, a specific volume of gas is required. In other words, upon appropriate triggering, a volume of compressed air or other gas is released from a power source chamber, and the forces are channeled through various chambers in the gun, eventually releasing in the paintball tag chamber to drive the paintball tag from the gun. Additionally, a specific and desired pressure must be attained in order to effectively fire the paintball tag.

Recent developments in the paintball gun industry have resulted in the advent of the well-known self-cocking mechanism for such air guns, so that, when the power source is released for firing the paintball tag, some of the energy produced thereby is used by the gun to self-cock the necessary mechanisms and to place another paintball from the paintball magazine into the barrel for firing. As a result of this development, the paintball gun has been found to consume available gas pressure and energy needed for projecting the paintball tag at the desired rate beyond its ability to replenish the available gas in the chamber. Consequently, there is a "drop-off" of air pressure in the air chamber. In other words, the various steps and procedures required to fire the paintball tag at an appropriate rate and distance, self-cock the gun to render it ready for firing the next paintball tag, and place a paintball tag from a magazine into the gun barrel for firing, consume a considerable amount of the compressed air power source available for a single firing, thus compromising the ability of a paintball gun to fire the paintball tag the preferred distance.

SUMMARY OF THE INVENTION

According to one aspect of the invention, there is provided a gas accumulator for attachment to a gun having a gun body, a compressed gas chamber in the gun body, and a compressed gas power source, the accumulator comprising: a body portion defining a gas accumulator chamber; connector means for connecting the accumulator releasably to the gun body so that the gas chamber in the gun body is in communication with the accumulator chamber; and compression means in the accumulator chamber which is compressed when the accumulator chamber receives gas under pressure, the compression means forcing gas from the accumulator chamber into the gas chamber when the gun is fired. Preferably, the body portion is an elongated tubular member.

The compression means may comprise a floating piston within the tubular member and a spring urging the floating piston in a direction so as to force gas tram the accumulator chamber into the gas chamber when the gun is fired. The spring may structured and dimensioned so as to provide a predetermined compressive force. The floating piston may structured and dimensioned so as to provide a predetermined compressive force.

Preferably, the connector means comprises a separate portion having a first end and a second end, the first end being connected to the body portion, and the second end being connectable to the gun body. The accumulator chamber may be of cylindrical shape, and may be substantially coaxial with the compressed gas chamber, when the gas accumulator is connected to the gun body.

In one embodiment, the connector means has an elongate section to pass through the front block of a gun.

In one aspect, the present invention addresses shortcomings in the prior art in so far as they relate to reduced pressure and force available by providing a front block accumulator, or an accumulator chamber, that attaches to the paintball gun through and existing hole in the front block thereof, and onto the gun body. The front block accumulator may replace the front block retainer bolt which is normally found in this position on the gun body.

The front block accumulator of the invention may slightly enlarge the compressed air chamber, and provide a spring-driven piston-type mechanism, both of which augment or supplement the compressive forces normally available in the gun, thus providing additional energy for operating the various mechanisms which rely on the compressed gas power source which may be activated upon firing of the gun. The increased size of the compressed air chamber permits a slightly larger volume of compressed air to be available as a power source, and this is coupled with the additional force provided by the spring and piston type head, which provide additional force to the outward movement of the compressed air, towards the paintball tag upon firing.

In one embodiment, the front block accumulator of the invention is designed so as to be easily integrated into existing paintball guns by simply removing the front block retainer bolt and inserting in its place the accumulator body which includes a threaded member received in the existing hole previously occupied by the front block retainer bolt.

Since the front block accumulator of the invention can be easily removed and replaced, it may also be possible attach to the gun body front block accumulators of the invention having differing sizes and specifications, so that, as desired, more or less compressive force is available in a particular application.

The front block accumulator chamber of the invention includes a spring, which is compressed under pressure when loaded, and the strength of the spring can be altered or changed by adjusting its physical characteristics such as the tension in the spring, its size, diameter or other features. In this way, the front block accumulator of the invention can be readily sized and dimensioned so as to achieve a particular purpose, or have a more effective and efficient firing capability in a given circumstance.

BRIEF DESCRIPTION OF THE DRAWINGS

FIGS. 3–7 are cross-sectional side views of the paintball gun of the invention, showing sequentially the movement and changes of position of various components during the firing of a paintball tag;

FIG. 8 is a detailed view of the front block accumulator of the invention in an assembled condition; and FIG. 9 is an exploded view of the front block accumulator of the invention, as shown in FIG. 8, showing more clearly the various components thereof.

DETAILED DESCRIPTION OF THE PREFERRED EMBODIMENTS

Figure 1:
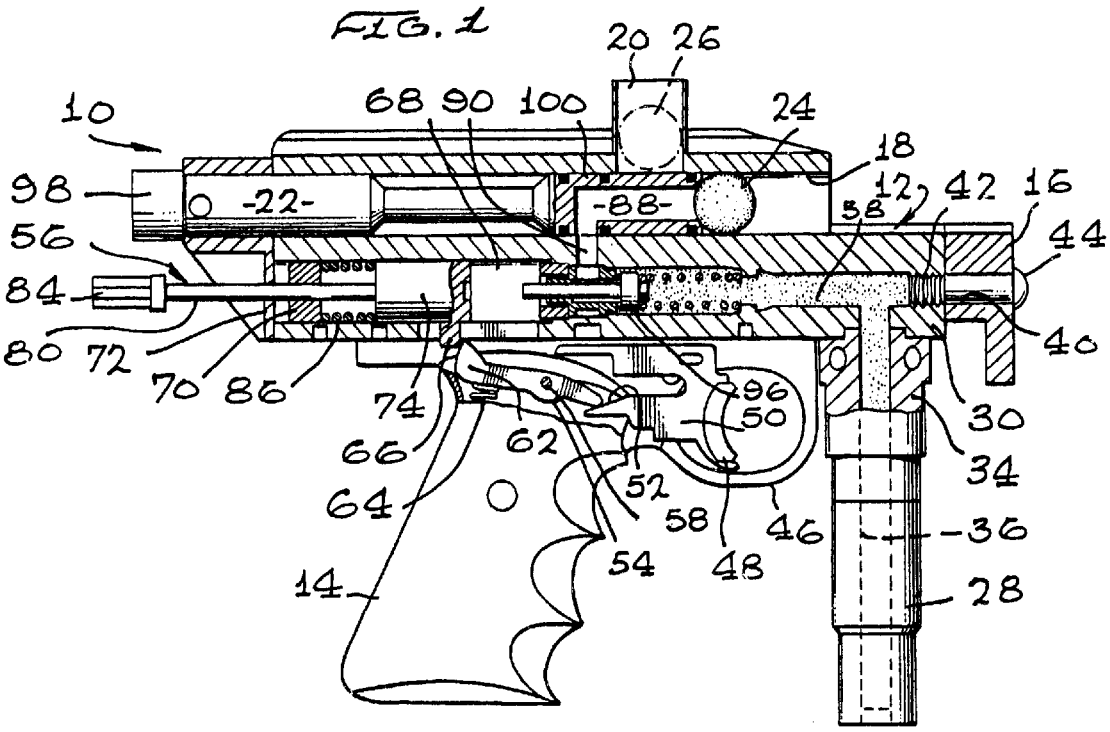
FIG. 1 is a side view, in cross-section, showing the mechanisms of a typical paintball gun of the prior art, without the accumulator front block of the invention.
Figure 2:
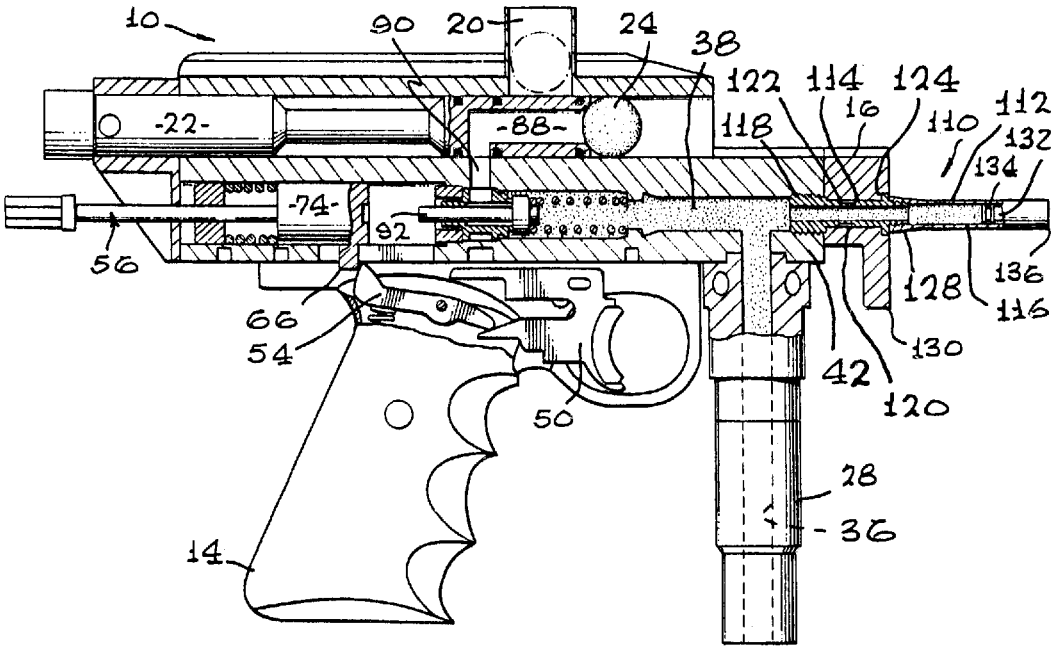
FIG. 2 is a side view, in cross-section, showing a paintball gun of the invention, including the accumulator front block of the invention.

FIGS. 1–7 of the attached drawings show a diagrammatic cross-section of a paintball gun. In FIG. 1 of the drawings, a prior art gun is shown, as will be described in more detail below, which includes the gun body and a retainer bolt inserted in an aperture at the front end thereof. FIG. 2 shows a substantially similar cross-sectional view of a paintball gun of the invention, and includes the front block accumulator aspect of the invention inserted in the aperture at the front of the gun, in place of the retainer bolt. In FIGS. 3–7 of the drawings, a cross-sectional side view of the gun of the invention, including the front block accumulator of the invention, is shown, showing the incremental movement of the various components and the flow of compressed air in order to propel the paintball tag from the gun. Finally, FIGS. 8 and 9 of the drawings show diagrammatic representations of the front block accumulator of the invention, showing its various parts and components.

Reference is now made to FIG. 1 of the drawings, which, as mentioned above, shows a gun 10 of the prior art, including a gun body 12, a grip 14 attached to the gun body 12, the gun body 12 having a front block 16.

The gun 10 further comprises a barrel 18, a paintball magazine 20 feeding the barrel 18, and a breech block 22 within barrel 18 used for loading and positioning a paintball tag. In FIGS. 1 and 2, a loaded paintball tag 24 is shown in the barrel 18, and an unloaded paintball tag 26 is shown in the paintball magazine 20, ready for loading once the paintball tag 24 has been ejected from the gun.

The gun 10 further comprises a power source 28 which can be releasably attached to and removed from the front end 30 of the gun body 12 by means of conventional attachment members. The power source 28 includes a telescope-style outer wall 34 which defines a compressed air passage 36, the compressed air passage 36 being in communication, when the power source 28 is in the attached position, to the compressed chamber 38 located within the gun body 12. Thus, when the power source 28 is properly attached to the gun body 12, air or gas under pressure within the compressed air passage 36 can flow freely and fully into the compressed air chamber 38.

The front block 16 includes an aperture 40, which is in communication with the compressed air chamber 38. The forward end 42 of the compressed air chamber 38 has a female thread, and, in a typical prior art configuration, a retainer bolt 44 passes through the aperture 40, and engages the female thread at the forward end 42 of the compressed air chamber 38. The retainer bolt 44 firmly holds the front block 16 to the front end 30 of the gun body 12, providing a seal to prevent the escape of compressed air therethrough. Removal of the retainer bolt 44, and front block 16 provides access to the compressed air chamber 38 for cleaning and maintenance purposes.

The gun 10 further comprises a trigger guard 46 and, within the trigger guard 46 in conventional fashion, a trigger 48. The trigger 48, in its normal position, is urged towards the front or power source 28 end of the gun. The trigger 48 has a trigger body 50, the trigger body 50 having an inclined ramp 52 at one end.

A lever 54 is located at the upper end of the rim 14 and acts as an intermediate, to be described, between the trigger body 50 and a firing hammer, generally represented by numeral 56. The lever 54 is pivotally mounted at fulcrum or pivot 58, and has an arm 60 which rests on the inclined ramp 52 of the trigger body 50. The lever 54 further includes, at its end remote from the arm 60, a projection 62. The projection 62 is urged upwardly by spring 64. As will be appreciated, pulling the trigger 48 backwards urges the trigger body rearwardly, causing the arm 60 to ride up the inclined ramp 52. This causes the lever 54 to rotate slightly about the pivot 58, and move the projection 62 downward, against the action of the spring 64. The projection 62 is moved downward a sufficient distance to allow an abutment 66, mounted on the firing hammer 56, to clear the top of the projection 62, to initiate the firing of the paintball, as will be described more fully below.

The gun 10 further comprises a hammer chamber 68, which houses the firing hammer 56. The hammer chamber 68 includes a fixed block 70 towards the rear thereof, and a rear outer wall 72, sealing off the hammer chamber 68. Within the hammer chamber 68, the firing hammer 56 is able to reciprocate, as will be described. The firing hammer includes a piston head 74, including a recess 76 at the front end 78 thereof, a piston rod 80 connected to the rear end 82 of the piston head 74, the piston rod 80 extending through apertures in the fixed block 70 and rear outer wall 72, and having a knob 84 at its opposite end. A spring 86 is located between the fixed block 70 and the rear end 82 of the piston head 74, and, in normal operation, urges the piston head 74 away from the fixed block 70 in the direction of the compressed air chamber 38.

The barrel 18 includes a barrel chamber 88, and is selectively in communication with the compressed air chamber 38 by means of an aperture 90 in the gun body 12. Between the aperture 90 and the compressed chamber 38, there is located a firing valve 92 movable generally between an open and closed position. In FIGS. 1 and 2 of the drawings, the firing valve 92 is shown in the closed position, where the compressed air chamber 38 is sealed off from the aperture 90. A spring 94 generally acts on a valve head 96 of the firing valve 92, thereby urging, under normal circumstances, the firing valve 92 into the closed position.

Figure 4:
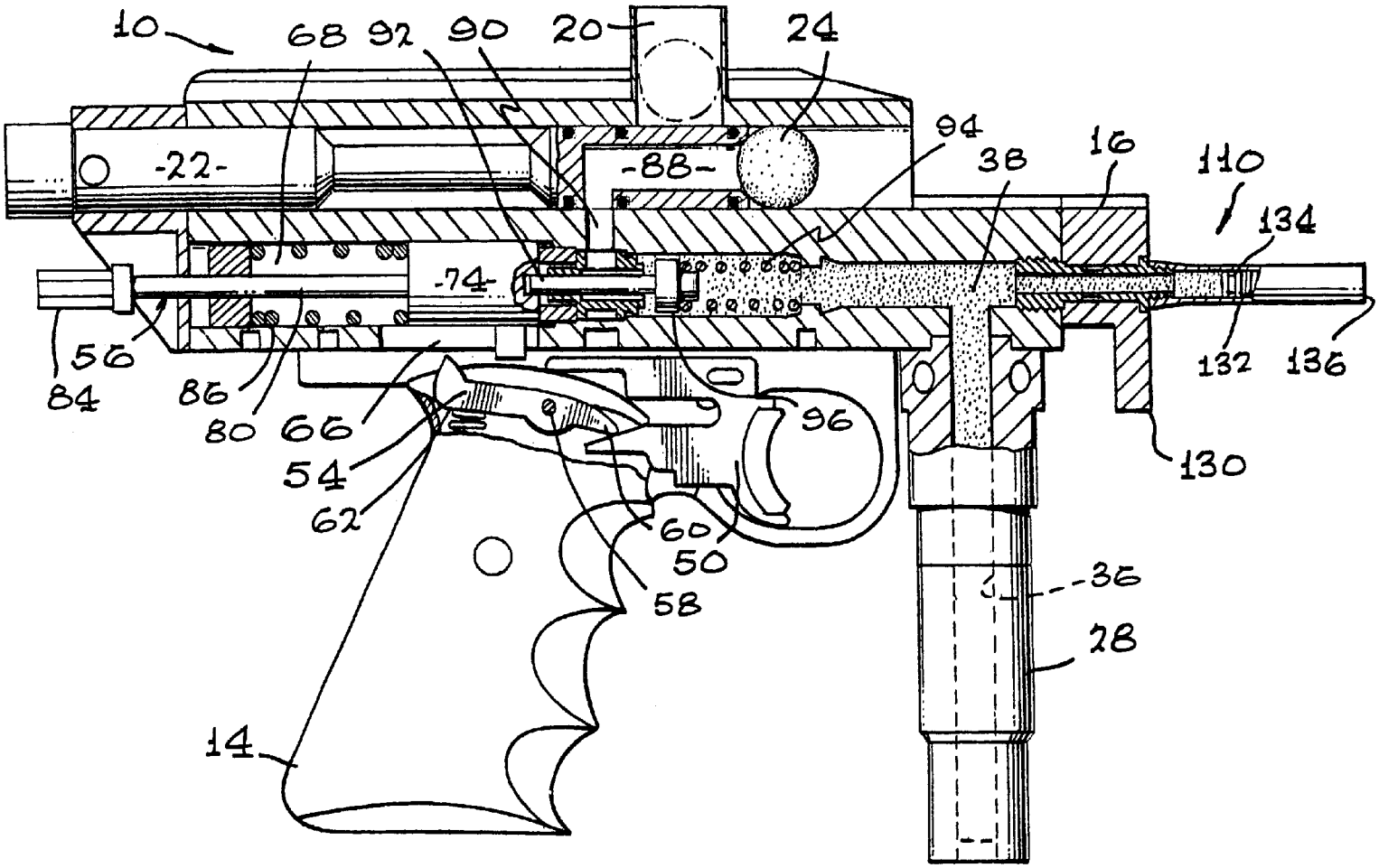
Figure 5:
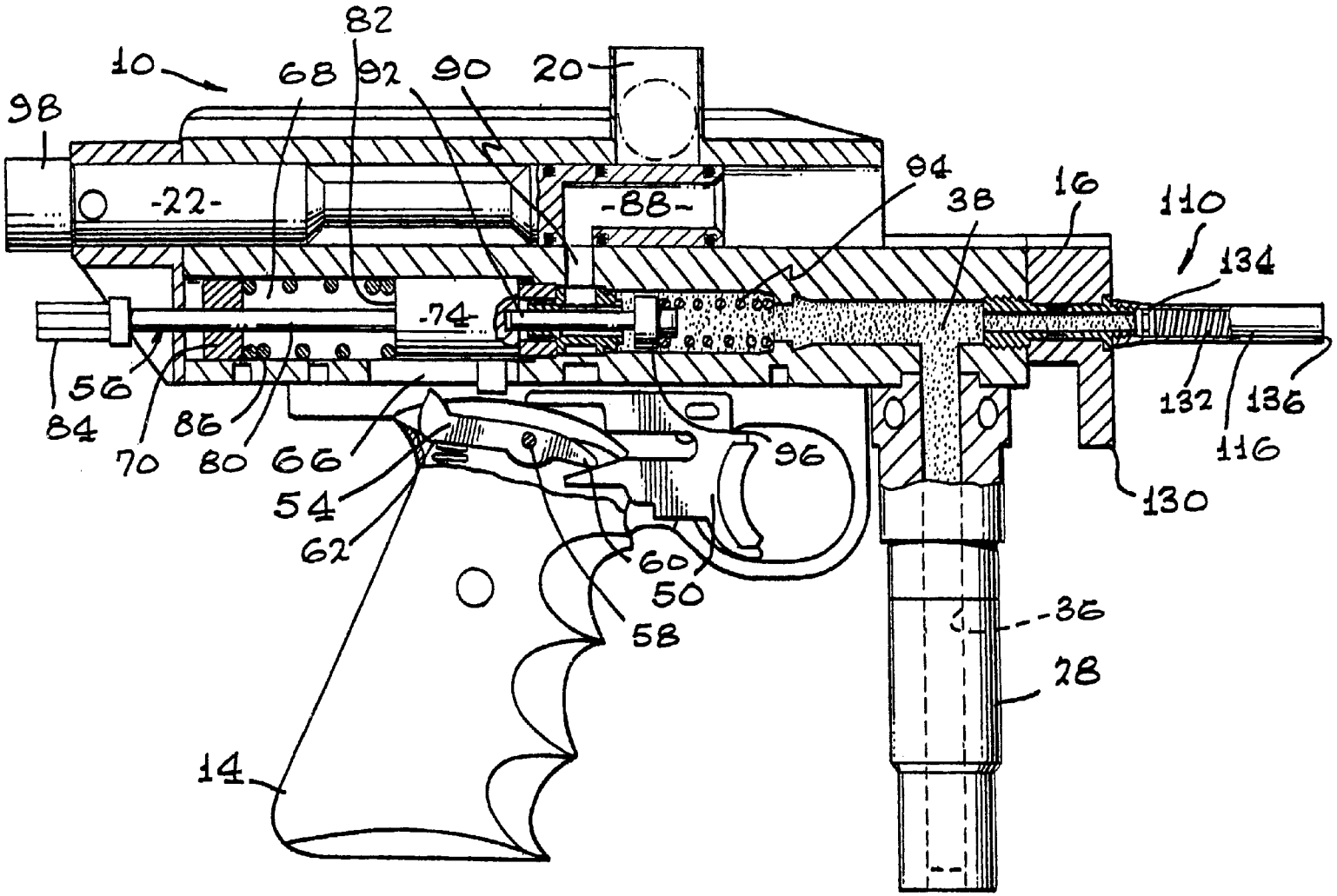

As will be described below, FIGS. 4 and 5 show the firing valve 92 in the open position. In this open position, the compressed air chamber 38 is placed in communication with the barrel chamber 88 through aperture 90, and compressed air is permitted to flow forcefully from the compressed air chamber 38, over the firing valve 92, through aperture 90, and into the barrel chamber 88. The force of the compressed air in the barrel chamber 88 provides thrust for the loaded paintball tag 24 which is expelled from the barrel.

The general operation of the gun 10 will now be described. FIGS. 1 and 2 both show a gun 10 substantially ready for firing, with the power source 28 mounted on the gun body 12, and the compressed air through passage 36 pressurizing the compressed air chamber 38. The front block 16 is shown attached to the front end 30 of the gun body 12, by means of the retainer bolt 44.

The user pulls back the trigger 48, causing the arm 60 to slide up the inclined ramp 52, thus pivoting the lever 54 and lowering the projection 62. When the projection 62 has dropped sufficiently, it will no longer be in a position to hold the abutment 66, thus permitting the firing hammer 56 to be forced forward within the hammer chamber 68. The spring 86 forces the piston head 74 forwardly towards the firing rod 96, and eventually the end of the firing rod 96 is received within the forwardly moving recess 76. The force and momentum of the piston head 74 forces the firing valve 92 against the action of the spring 94, moving the firing valve forwards, and thereby opens communication between the compressed air chamber 38 and the barrel chamber 88 via the aperture 90. The force of the compressed air in the chamber 38 floods through into the barrel chamber 18, propelling the loaded paintball 24 in the barrel 18, and out of the gun 10.

As the burst of compressed air passes into the barrel chamber 88, the firing valve 92 will be forced back into the closed position by both the spring 94 and compressed air in the chamber 38, not only moving the firing valve into the closed position, but also providing sufficient force to strike the piston head 74, moving it backward within the hammer chamber 68, until it is once more retained in its restrained position when the abutment 66 passes over the projection 62 and is held in this position.

The next paintball tag can then be loaded into position by pulling backwardly on the breech block 22, by grasping the handle 98, and pulling the entire breech block rearwardly until the front portion 100 moves back sufficiently to allow the unloaded paintball tag 26 to drop into barrel 18. Subsequent forward movement of the breech block 22 places the paintball tag 26 into a loaded position, ready for firing.

Reference is now made to FIG. 2 of the drawings, showing a gun 10, in many respects identical to that shown in FIG. 1 of the drawings. As will be noted, the retainer bolt 44 shown in FIG. 1, and holding the front block 16 to the front end 30 of the gun body 12, has been removed, and, in its place there is positioned a front block accumulator 110. The front block accumulator 110 comprises a body portion 112, and a fastening portion 114, the body portion 112 and fastening portion 114 being coaxial with respect to each other, and defining a continuous accumulator chamber 116.

The fastening portion 114 has a threaded end 118, and an unthreaded tubular section 120. The threaded end 118 is designed to engage the threaded forward end 42 of the compressed air chamber 38, while the unthreaded tubular section 120 passes through the aperture 40 of the front block 16. A pair of seals 122 and 124 are provided between the unthreaded tubular section 120 and the aperture 40 in the front block 16, to provide a good seal between these components. When the front block accumulator 110 is inserted with the threaded end 118 in the front end 30, the accumulator chamber 116 is brought into communication with the compressed air chamber 38.

The body portion 112 of the front block accumulator has a slightly widened end 126, forming a step 128 having a vertical component. The step 128 has as its vertical component a wall which abuts against the front block 16 such that, when the threaded end 118 is firmly engaged and connected to the threaded forward end 42 of the compressed air chamber 38, the front block 16 will be firmly sandwiched between the front block accumulator 110 and the forward end of the gun body 12.

The accumulator chamber 116 and the body portion 112 of the front block accumulator 110 includes a spring 132 and a floating piston 134. The spring 132 normally urges the floating piston 134 forward, towards the compressed air chamber 38. The spring 132 thus has two ends acting between the floating piston 134 and the rear wall 136 of the front block accumulator 110.

It will be noted that the presence of the front block accumulator provides additional force, pressure and energy for ejecting a paintball tag from the barrel, by effectively enlarging the size of the compressed air chamber 38 and thus providing a larger volume of compressed air or gas available for firing a paintball tag, and also providing the additional force produced by the movement of the floating piston 134 which rapidly and effectively expels the compressed air or gas located in the chamber 38, preventing a dropping-off of air pressure in the air chamber.

The operation and effect of the front block accumulator 110 may best be viewed by noting the sequence of changes that occur during the firing operation, certain critical stages of which are represented in the FIGS. 3–7 of the drawings.

Figure 3:
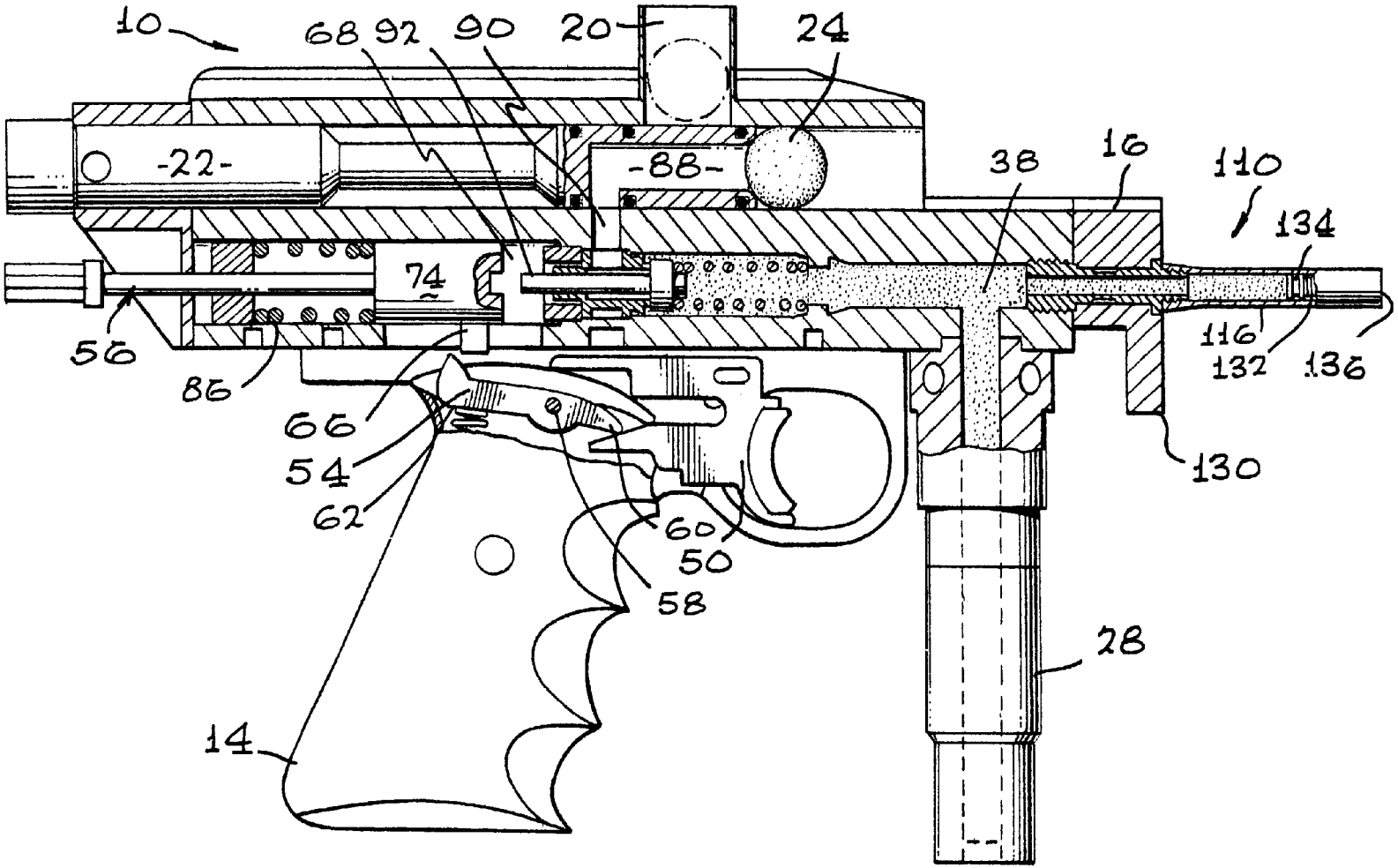

First, and with reference to FIG. 3, it will be seen that the trigger 48 has been pulled backwards, the lever 54 has pivoted about pin 58, and the projection 62 has dropped, allowing the abutment 66 to slide forward. The piston head 74 of the firing hammer 56 is moving through the hammer chamber 68. Eventually, the spring 64 will push up the projection 62. In the meantime, the force of the spring 86 is thrusting the piston head 74 forward within the hammer chamber 68.

With reference to FIG. 4 of the drawings, the piston head 74 has moved fully forward within the chamber 68 by the urging of spring 86, and the firing rod 96 has been received within recess 76. The force of the piston head 74 has moved the firing valve 92 forward, so that the valve head 96 is moved away from surfaces 138, thereby placing the compressed air chamber 38 in communication with the barrel chamber 88, via the aperture 90 in the gun body 12. In the "snap-shot" shown in FIG. 4, the compressed air has filled the barrel chamber 88, and has reached the loaded paintball tag 24.

While the firing valve 92 is in the open position, as shown in FIG. 4, a burst of compressed air is able to enter the barrel chamber 88 to eject the paintball tag 24. It will also be noted that, in FIG. 4 of the drawings, compressed air contained within the accumulator chamber 116 is also being forced into the compressed air chamber 38 by the force of the unwinding spring 32 acting on the floating piston 134.

It will thus be appreciated that the compressed air chamber 38 is being charged from two sources, namely, the power source 28 through the compressed air passage 36, and from the front block accumulator 110 through compressed air loaded into the accumulator chamber 116.

In FIG. 5 of the drawings, the compressed air has expelled the paintball tag 24 from the barrel 18. The firing hammer 56 and the firing valve 92 are still in the same positions as described with reference to FIG. 4. It will, however, be noted that in FIG. 5, the spring 132 has forced the floating piston 134 forward to the approximate level of the front block 16, thus expelling all the compressed air contained within the front block accumulator 110 into the compressed air chamber 38. The amount of compressed air entering the chamber 38, and thus available for firing the paintball tag 24, and restoring the firing valve 92 and firing hammer 56 to the original cocked position has therefore been supplemented and augmented, enhancing the effectiveness of the gun, and providing sufficient power from the various sources to shoot the paintball tag a desired distance, and self-cock the gun.

Figure 6:
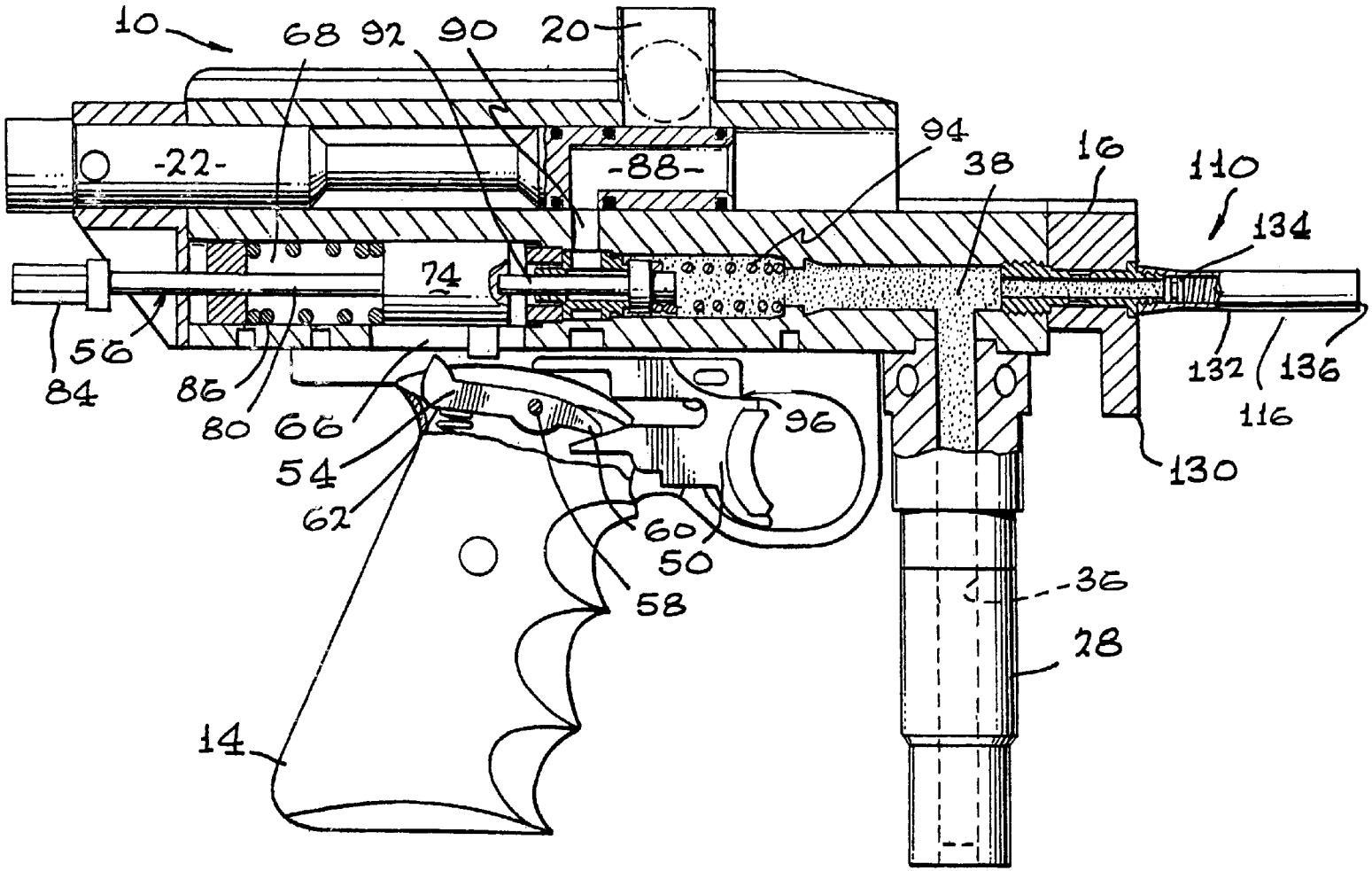

In FIG. 6 of the drawings, the firing valve 92 has moved back to its closed position, once again sealing off the compressed air chamber 38, and recharging of the chamber 38 as well as the front block accumulator 110 now takes place by the release of the further amounts of compressed air or gas contained within the power source 28. Furthermore, the closure of the firing valve 92 has caused the firing hammer 56, and particularly the piston head 74 hereof, to move backward into the hammer chamber 68, against the action of the spring 86. The force of the closure is sufficient to move the piston head 74 backward in the hammer chamber 68 until the abutment 66 moves over the projection 62, and is held in place. Alternatively, the firing hammer 56 can be pulled back in the hammer chamber 68 by pulling back on the knob 84, fixed to the piston rod 80.

The closure of the firing valve 92 causes recharging of the compressed air chamber 38. Air begins to fill the accumulator chamber 116, forcing back the floating piston 134 against the action of the spring 132.

FIG. 7 of the drawings illustrates the position, much the same as the start position, where the front block accumulator 110 has been fully recharged by the pressure of the compressed air in the power source, pushing to the maximum the floating piston 134 towards the rear wall 136, and compressing the spring 132. A newly loaded paintball tag 24 is in the chamber 118, by virtue of the breech block 22 having been pulled back so that the front portion 100 opens the paintball magazine 20 to allow a further paintball to drop into the barrel, ready for firing.

As will be seen with reference to the various drawings and the description of the steps involved once compressed air has been released from the firing of a paintball tag, a more efficient way of providing additional power for firing and re-cocking, or self-cocking the gun is provided. In prior art devices, when the gas in the air chamber has been consumed, the pressure in the air chamber drops. As this pressure drops, the spring-loaded piston pushes or injects the gas that is in the front block accumulator, into the air chamber, thus causing it to maintain a constant pressure and flow of gas. As the valve in the air gun closes, the air chamber pressure rises, pushing the piston and compressing the spring to its preset pressure.

Reference is now made to FIGS. 8 and 9 of the drawings, which show a slightly different embodiment of a front block accumulator of the invention. The front block accumulator 150 comprises a cylindrical body portion 152 having a front threaded end 154, and a rear wall 156, including an aperture 158. The cylindrical body 152 defines a cylinder chamber 160 which receives a spring 162 and a floating piston 164. The diameter of the floating piston 164 corresponds with that of the cylinder chamber 160. The floating piston 164 may be forced forwardly or rearwardly within the cylinder chamber 160, as will be described below.

The front block accumulator 150 further comprises a connector member 166, having a first threaded end 168, which engages in the front end 154 of the cylindrical body 152. As shown in FIG. 8, the connector member 166, when threadedly engaged with the cylindrical body 152, encloses the spring 162 and floating piston 164 for movement therein.

The connector member 166 has a second threaded end 170 which is received in the threaded forward end 42 of the compressed air chamber 38. Where a front block accumulator 150 of the type shown in FIGS. 8 and 9 is used, the retainer bolt 44 and front block 16 are removed, and both are replaced by the front block accumulator 150, with the second threaded end 170 being received within the forward end 42. As an alternative, the front block 16 may be retained, and the mid-section 172 of the connector member 166 would pass through the aperture 40 of the front block 16.

The front block accumulator 150 shown in FIGS. 8 and 9 of the drawings operates in essentially the same manner as that described with reference to the previous Figures. In other words, the cylinder chamber 160 is charged with compressed air, forcing the floating piston 164 backwards against the action of the spring 162, and, in this charged condition, is ready to augment the output from the compressed air chamber 38. Upon firing of the gun, the thrust of the spring 162 forces the compressed air out of the cylinder chamber 160, and into the compressed air chamber 38, providing the additional pressure and force, as has already been described with reference to the previous drawings.

One important feature of the front block accumulator of the invention is that it allows removal of the accumulator without having to remove any of the pneumatics from the front block. This facilitates maintenance of the front pneumatics, and there is no need to remove the front block from the gun. In other words, the front block accumulator in an easy add-on and removable component, which can act as an appendage to the remainder of the gun, without the need for changing any of the hardware, or adjusting any of the components, in order to attach it to the gun.

Another important feature of the front block accumulator of the invention is that its structural components can be varied according to need. First, the size of the cylinder chamber, or accumulator chamber can be varied, as can the size, tensile strength, and structure of the springs. Further, optional adjusters for varying the size and diameter of the floating piston can also be employed so as to custom design a particular front block accumulator for a given purpose, application or circumstance.

It will therefore be appreciated that the invention can be modified and varied, and is not limited to the precise constructional details of the specific embodiments described herein.

What is claimed is:

1. A gas accumulator for attachment to a gun having a gun body, a compressed gas chamber in the gun body, and a compressed gas power source, the accumulator comprising:

a body portion defining a gas accumulator chamber;

connector means for connecting the accumulator releasably to the gun body so that the gas chamber in the gun body is in communication with the accumulator chamber; and compression means in the accumulator chamber which is compressed when the accumulator chamber receives gas under pressure, the compression means forcing gas from the accumulator chamber into the gas chamber when the gun is fired.

2. A gas accumulator as claimed in claim 1 wherein the body portion is an elongated tubular member.

3. A gas accumulator as claimed in claim 2 wherein the compression means comprises a floating piston within the tubular member and a spring urging the floating piston in a direction so as to force gas from the accumulator chamber into the gas chamber when the gun is fired.

4. A gas accumulator as claimed in claim 3 wherein the spring is structured and dimensioned so as to provide a predetermined compressive force.

5. A gas accumulator as claimed in claim 3 wherein the floating piston is structured and dimensioned so as to provide a predetermined compressive force.

6. A gas accumulator as claimed in claim 1 wherein the connector means comprises a separate portion having a first end and a second end, the first end being connected to the body portion, and the second end being connectable to the gun body.

7. A gas accumulator as claimed in claim 1 wherein the accumulator chamber is of cylindrical shape, and is substantially coaxial with the compressed gas chamber, when the gas accumulator is connected to the gun body.

8. A gas accumulator as claimed in claim 1 wherein the connecter means is a bayonet-type connector for attaching the accumulator to the gun body.

9. A gas accumulator as claimed in claim 1 wherein the connector means has an elongate section to pass through the front block of a gun.

* * * * *

UNITED STATES PATENT AND TRADEMARK OFFICE

CERTIFICATE OF CORRECTION

PATENT NO. : 6,577,542 B2 
DATED : June 10, 2003
INVENTOR(S) : Gilbert Wolrich, Debra Bernstein and Matthew J. Adiletta It is certified that error appears in the above-identified patent and that said Letters Patent is hereby corrected as shown below:

Column 1,
Lines 3-5, delete existing paragraph and add the following new paragraph:
-- This application is a continuation of U.S. Serial Number 09/473,111, filed December 28, 1999, issued as U.S. Patent 6,307,789. --

Signed and Sealed this

Ninth Day of September, 2003

JAMES E. ROGAN
*Director of the United States Patent and Trademark Office*